US009802241B2

(12) United States Patent
Zielke et al.

(10) Patent No.: US 9,802,241 B2
(45) Date of Patent: Oct. 31, 2017

(54) FLAT SEMI-FINISHED PRODUCT MADE OF METAL AND METHODS FOR PRODUCING SAME AS WELL AS COMPONENTS THEREOF

(75) Inventors: Gerd Zielke, Altwarp (DE); Karl-Christian Regent, Wolfenbuettel (DE)

(73) Assignee: DBW Holding GmbH, Bovenden (DE)

( * ) Notice: Subject to any disclaimer, the term of this patent is extended or adjusted under 35 U.S.C. 154(b) by 627 days.

(21) Appl. No.: 13/643,118

(22) PCT Filed: Apr. 28, 2011

(86) PCT No.: PCT/EP2011/002143

§ 371 (c)(1),
(2), (4) Date: Dec. 17, 2012

(87) PCT Pub. No.: WO2011/134664

PCT Pub. Date: Nov. 3, 2011

(65) Prior Publication Data

US 2013/0095341 A1 Apr. 18, 2013

(30) Foreign Application Priority Data

Apr. 28, 2010 (DE) ..... 10 2010 018 676

(51) Int. Cl.
*B21H 8/00* (2006.01)
*E04C 3/07* (2006.01)
(Continued)

(52) U.S. Cl.
CPC ..... *B21H 8/00* (2013.01); *E04C 2/08* (2013.01); *E04C 2/326* (2013.01); *E04C 3/07* (2013.01);
(Continued)

(58) Field of Classification Search
None
See application file for complete search history.

(56) References Cited

U.S. PATENT DOCUMENTS 7,152,911 B1 * 12/2006 McNulty et al. ..... 296/184.1
7,290,827 B2 * 11/2007 McNulty et al. ..... 296/183.1
(Continued)

FOREIGN PATENT DOCUMENTS

DE 1036678 B 8/1958
DE 69000200 T2 3/1993
(Continued)

OTHER PUBLICATIONS

Fastener Mart, "Understanding Tapping Screws", http://www.fastenermart.com/html/tapscrew.html, accessed Aug. 31, 2015.*
(Continued)

*Primary Examiner* — Humera Sheikh
*Assistant Examiner* — Lucas Wang
(74) *Attorney, Agent, or Firm* — Whitham, Curtis & Cook, P.C.

(57) ABSTRACT

The invention relates, in a first aspect, to a flat semi-finished product made of metal (1), wherein said semi-finished product comprises at least out structured section (2) and at least one non-structured section, wherein said semi-finished product has non-structured edge sections (4) and exhibits a high strength. The semi-finished product made of metal (1) according to the invention is characterized in that it is designed as one piece and predetermined sections (2) are structured and predetermined sections are non-structured, wherein at least one non-structured section (4) is designed as a connecting region for positive or non-positive connection or for connecting by bonding. Furthermore, methods for producing the semi-finished products according to the invention are provided.

13 Claims, 2 Drawing Sheets

Figure 1:
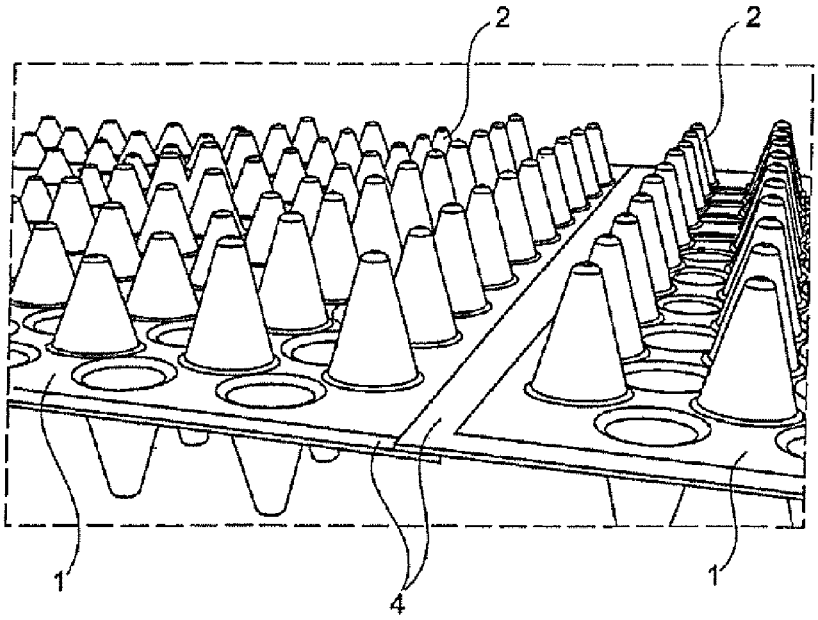

(51) Int. Cl.
*E04C 2/32* (2006.01)
*E04C 2/08* (2006.01)

(52) U.S. Cl.
CPC .. *Y10T 428/1241* (2015.01); *Y10T 428/12361* (2015.01)

(56) References Cited

U.S. PATENT DOCUMENTS

| | | | | |
|---|---|---|---|---|
| 2007/0251168 | A1* | 11/2007 | Turner | 52/288.1 |
| 2010/0230085 | A1* | 9/2010 | Feng et al. | 165/185 |

FOREIGN PATENT DOCUMENTS

| | | | | | |
|---|---|---|---|---|---|
| DE | 10009105 | C1 | | 7/2001 | |
| DE | 202008013755 | U1 | | 4/2009 | |
| EP | 1504827 | A1 | | 2/2005 | |
| EP | 1772206 | | * | 4/2007 | B21D 13/04 |
| GB | 2270535 | A | | 3/1994 | |
| GB | 2302106 | A | | 1/1997 | |
| WO | 9505571 | A2 | | 2/1995 | |

OTHER PUBLICATIONS

Wikipedia, “Tap and die”, <https://en.wikipedia.org/wiki/Tap_and_die>, accessed Apr. 26, 2017.*

* cited by examiner

FLAT SEMI-FINISHED PRODUCT MADE OF METAL AND METHODS FOR PRODUCING SAME AS WELL AS COMPONENTS THEREOF

The present application relates in a first aspect to a flat semi-finished product made of metal, wherein said semi-finished product exhibits at least one structured section and at least one non-structured section, wherein said semi-finished product has non-structured edge sections and exhibits high strength. The semi-finished product made of metal according to the invention is characterized in that it is configured in one piece and that pre-determined sections are structured and predetermined sections are non-structured, wherein at least one non-structured section is configured as a connecting region for substance-bonded, positive or non-positive connection.

Furthermore, methods of producing the semi-finished products according the invention are provided.

STATE OF THE ART

Flat semi-finished products made of metal are used in various technical fields. Sheet metal parts of this kind are used as heat-insulating or sound-damping liners in the engine compartment or underbody area of motor vehicles. However, corresponding semi-finished products or formed components are also used as protective shields against external contamination or damage. These semi-finished products or formed components are usually made of metals, such as steel or high-grade steel, but also aluminum. In this case, the sheet metals are formed and stamped in a first step. With the help of stamping, the sheet metals are thereby reinforced. At the same time, an improved and thereby optimized heat flow is achieved. These stamped semi-finished products, which are usually produced as metal blanks or rolled goods, are then processed in a further processing stage, e.g. in a cutting process. If necessary, corresponding notches are stamped or cut out of the sheet metal, in order to achieve a connection between these sheet metals and other components. Welding of the sheet metal components to other components is also frequently required. As explained, these sheet metals are used in the automobile industry, particularly as sound-absorbing insulation packs or heat shields for vehicles. In order to produce sheet metals of this kind, flat or sheet materials are usually fed through a pair of stamping rollers, in order to achieve the desired sheet metal structure. Structuring/stamping of this kind may be knob-shaped, wavelike or rhombus-shaped. When employed as sound-absorbing insulation packs or heat shields in vehicle or automobile manufacture, for example, these sheet metals are used as stacks or as composites in conjunction with other insulating materials, such as mineral insulating or proofing materials or those on a steel fiber basis. These composites allow good heat dissipation combined with simultaneous sound absorption.

However, the methods known hitherto and the sheet metals thereby produced display disadvantages. Hence, these structured sheet metals are disadvantageous in further processing, as no flat surface is obtained during subsequent processing, e.g. during cutting processes, which facilitates joining, e.g. welding. Furthermore, no accurate cutting lines can be obtained during cutting processes, in order to obtain precise raised edges, for example. The areas with notches for substance-bonded, positive or non-positive connection to a further component, e.g. by screws etc., are not optimally configured by the structuring either, as the edges of the notches are not planar on account of the structuring and a corresponding substance-bonded or non-positive connection is therefore made difficult. In order to achieve this, extensive reworking is required, such as re-flattening of the already structured surfaces. Alternatively, components were developed from individual elements, which also particularly exhibit different materials, such as plastics and metals. These individual elements for the various sections of the semi-finished product or of the component are then connected together in further working steps, e.g. by bonding or using correspondingly suitable means. This means, however, that further labor-intensive steps have to be taken during production.

There is therefore a need for semi-finished products or components made of metal, which can be particularly used to overcome the aforementioned disadvantages and which can be obtained using a simple method.

DESCRIPTION OF THE INVENTION

The problem addressed by the invention is that of providing components made of metal, which are particularly suitable as guard plates, heat-insulation and/or proofing plates in the vehicle sector, wherein an improved connection with further components is possible with these components and these components can be supplied by a simpler method. This problem is solved by the invention specified in patent claims 1, 8 and 10. The dependent claims contain advantageous developments of the invention.

In a first aspect, the present invention relates to flat semi-finished products made of metal, wherein said semi-finished product has at least one structured and at least one non-structured section, wherein said semi-finished product exhibits non-structured edge sections and said semi-finished product exhibits high strength due to the structuring, characterized in that the semi-finished product exhibits at least one predetermined structured section and at least one predetermined non-structured section and the structured sections are differently stamped sections where necessary, wherein at least one non-structured section is configured as the connecting region for the substance-bonded, positive or non-positive connection. The semi-finished products in this case are preferably made from a single metal. These semi-finished products are particularly used as guard plates, heat-insulation or proofing sheets for the vehicle sector. Furthermore, the present invention focuses on a method of producing flat semi-finished products made of metal according to the invention comprising the step involving the single-stage pressing or stamping of metal sheets using suitable tools, wherein said tools are configured such that they exhibit predetermined structured and non-structured sections and are therefore able to configure both structured and non-structured sections in the metal sheet simultaneously in one step, for the production of a flat semi-finished product which is particularly a one-piece semi-finished product.

Due to the non-structured sections in the edge section and in the section configured as the connecting region for substance-bonded, positive or non-positive connection to a further component, costly reworking of the semi-finished product is unnecessary. The non-structured sections are predetermined in this case such that they coincide with the edge sections of the semi-finished product and the connecting regions of the semi-finished product to other components or to a further or the same non-structured section of the component itself. Structured sections are preferably located in the sections of the semi-finished product which are provided for heat flow or for insulation or proofing.

The semi-finished products are characterized in that they have precise cutting lines and exhibit planar, i.e. non-structured, surfaces in the areas of the notches and is preferably configured in one piece. Structured surfaces are particularly configured in areas where reinforcement or heat-flow optimization is required.

By means of targeted non-structured sections, i.e. predetermined non-structured sections in the flat semi-finished product, it is possible to configure a connection to other components or non-structured sections of the same component such that adjacent surfaces fit accurately, e.g. by means of welding, screwing, riveting, clinching or other kinds of mechanical connections, i.e. these sections are particularly suitable for the substance-bonded, positive or non-positive connection of components.

The structured and non-structured sections are furthermore disposed in a predetermined manner such that adjacent components can be correspondingly closely arranged, without having to dispense with surrounding structural stampings and without re-flattening these sections with a further processing step where there are pre-structured surfaces. The repeated flattening and therefore further stressing of the material is avoided and cracking is prevented. This leads to improved durable stability, particularly in the screwing area, for example.

The predetermined non-structured sections may furthermore correspond to the sectional areas, particularly in the case of coil and plate material, so that the finished components can be correspondingly cut out of the rolled goods or the plate-shaped semi-finished products.

The flat semi-finished products made of metal according to the invention may exist in plate form in this case or be manufactured as rolled goods. In particular, these flat semi-finished products are configured as one-piece semi-finished products and are not formed from individual elements, e.g. by bonding individual elements made of different materials.

Semi-finished products made of metal in this case are preferably those made purely of zinc, brass, copper, aluminum, steel and high-grade steel or of a combination of these.

The structured sections are particularly those exhibiting beaded, cup-shaped and/or coarse-grain stamping. The stamping may be knob-shaped, wavelike or rhombus-shaped. Stampings in this case may run in different directions, i.e. in a vertical and horizontal stamping direction. In this case, the structures may be of the same height or of different heights. Furthermore, the structures may be formed on only one side of the semi-finished structure. This means that the structured sections may exhibit different structures, depending on the requirements made of said sections, e.g. to optimize the heat flow or for reinforcement of these sections.

At least one non-structured area preferably exhibits at least one notch, in order to allow a positive or non-positive connection. In a further preferred embodiment, all edge sections are non-structured.

The method according to the invention for the production of the flat semi-finished product made of metal in accordance with the present invention comprises the step of pressing or stamping the preferably one-piece metal sheet with corresponding tools, wherein said tools are configured such that structured and non-structured sections are formed in predetermined sections, in order to allow the production of the flat semi-finished product according to the invention. In a forming step, structured and non-structured sections can thereby be simultaneously configured in the metal sheet.

The method according to the invention may in this case be carried out by means of press tools consisting of an upper tool or a lower tool. Alternatively, it may be carried out by rotation stamping between counter-rotating rollers, which each contain the structure of the matrix geometry being stamped. A further alternative consists of a rotation-stamping method, wherein only between counter-rotating rollers, in which only one represents the structure of the matrix geometry being stamped and the other contains a surface made of a coating which receives the structure, e.g. rubber.

In a further alternative embodiment, the method according to the invention may be one in which the semi-finished product according to the invention is produced by rotation stamping. In this case, only one roller is moved in or also in and out over a plate or coil phase.

The rotation method is, for example, one with rollers with a variable grain intensity and variable grain number. In this case, these grains may be configured such that they can be pushed out by means of a conical mandrel or pneumatic jaws, for example, in order to configure the grains at the level or also over the surface of the roller with a different number. Different structures can thereby be formed in a forming step using a tool.

The invention is further directed at preferably one-piece semi-finished products which can be produced using the methods according to the invention.

Furthermore, the present invention is directed at preferably one-piece components made of a flat semi-finished product made of metal according to the invention. These components are particularly configured such that they are suitable as components for guard plates, heat-insulation or proofing plates in the vehicle sector.

The invention is further explained below with reference to the figures.

FIG. 1 shows a detail of positively-connected semi-finished products made of metal 1 according to the invention, with structured sections 2 and non-structured edge sections 4. The flat one-piece semi-finished products according to the invention allow a positive connection of these semi-finished products through the non-structured sections of the edge sections 4 produced in the one-stage forming method. The structured sections 2 allow optimized heat flow and stability.

Figure 2:
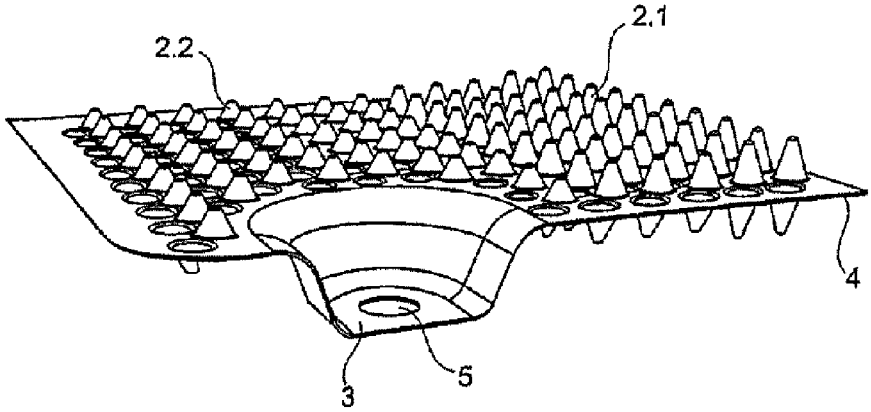

FIG. 2 shows an embodiment according to the invention of the flat semi-finished product 1 with different structured sections (2.1, 2.2) and non-structured sections 3 and 4. The non-structured section 3 has a notch 5. With the help of this notch 5 in the non-structured section 3, a non-positive connection of the semi-finished product according to the invention to another component, for example, is possible. The structured section 2 is divided into two different sections 2.1 and 2.2. The existing structured sections differ in this case due to the different heights of the stampings. The non-structured section 3 is configured as a depression, in order to facilitate a connection to another component through a corresponding connecting means, such as via screw connections, which are conducted through the notch 5. The edge section 4 is likewise configured as a non-structured section, in order to allow a connection to another component. A mechanical connection by riveting, clinching, screwing, for example, is possible via the non-structured sections but also by welding or bonding.

Figure 3:
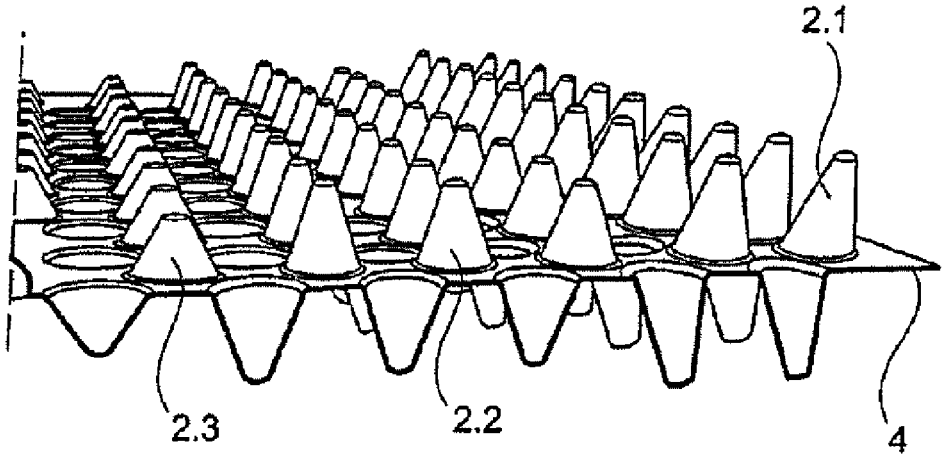

FIG. 3 shows a detail of a flat component 1 according to the invention, wherein these structured sections 2.1, 2.2, 2.3 are shown with different heights and different directions. In other words, the sections show on the one hand stampings of different height, sections 2.1, 2.2 and 2.3. Furthermore, the stampings in section 2.1 differ from those in sections 2.2 and 2.3 in that the center axis of the stampings in section 2.1 is inclined, while the center axis in sections 2.2 and 2.3 is perpendicular. The embodiment of the different structured sections enables the heat flow to be optimized. The different structures furthermore allow the formation of different strengths. With the help of the method according to the invention, the flat semi-finished products according to the invention can be produced in one forming step. Further processing steps are thereby avoided, particularly those steps in which the structured sections have to be flattened again, leading to further stress on the material. A lasting improvement in material properties is thereby achieved in the connecting and securing regions.

REFERENCE NUMBER LIST

1: Flat semi-finished product
2, 2.1, 2.2, 2.3: Structured sections
3: Non-structured section
4: Edge section
5: Notch

The invention claimed is:

1. A flat semi-finished product, comprising a metal structure having a top and a bottom, wherein said metal structure includes at least one structured section exhibiting at least one of beaded, cup-shaped or coarse-grain stampings formed in at least one of said top and said bottom of said metal structure, wherein if more than one structured section is present then said sections are differently stamped sections where necessary, at least one non-structured section configured as the connecting region for a substance-bonded connection, a positive connection, or a non-positive connection, and non-structured edge sections at one or more edges of said metal structure, wherein at least one of said at least one non-structured section and said non-structured edge sections surrounds at least one preformed notch which passes through said metal structure and extends from said top to said bottom of said metal structure, wherein said notch is not in said at least one structured section, and wherein said at least one preformed notch is formed in a depression adjacent to at least one of said non-structured section and said non-structured edge sections.

2. The flat semi-finished product as claimed in claim 1, wherein said semi-finished product is made purely of zinc, brass, copper, aluminum, steel and high-grade steel or of a combination of these.

3. The flat semi-finished product as claimed in claim 1, wherein said semi-finished product is manufactured in plate form or as rolled goods.

4. The flat semi-finished product as claimed in claim 1, wherein the structured sections exhibit beaded, cup-shaped and/or coarse-grain stampings, which are stamped in different directions, both horizontally and vertically, where necessary.

5. The flat semi-finished product as claimed in claim 1, wherein at least two structured sections exist and these exhibit at least two structured sections with different structures or stampings.

6. The flat semi-finished product as claimed in claim 1, wherein all edge sections are non-structured.

7. The flat semi-finished product as claimed in claim 1, wherein said flat semi-finished product is one-piece.

8. The flat semi-finished product as claimed claim 1, wherein said flat semi-finished product is configured as a guard plate, heat-insulation or proofing plate for a vehicle.

9. A method for producing the flat semi-finished product as claimed in claim 1, comprising the single-stage step involving the pressing or stamping of a metal sheet with predetermined structured and non-structured sections using suitable tools for the production of a flat semi-finished product made of metal.

10. The method as claimed in claim 9, wherein the flat semi-finished product is produced by rotation stamping using counter-rotating rollers.

11. A component made from the flat semi-finished product as claimed in claim 1 or producible according to the method as claimed in claim 9.

12. The component as claimed in claim 11, wherein said component is configured as a guard plate, heat-insulation or proofing plate for a vehicle.

13. A guard plate, heat-insulation and/or proofing plate comprising the semi-finished product as claimed in claim 1 or the component as claimed in claim 11.

* * * * *